US005897306A

United States Patent [19]

Beck

[11] Patent Number: 5,897,306

[45] Date of Patent: Apr. 27, 1999

[54] PARTITION AND PILOT RING FOR SCROLL MACHINE

[75] Inventor: Norman G. Beck, Sidney, Ohio

[73] Assignee: Copeland Corporation, Sidney, Ohio

[21] Appl. No.: 08/842,895

[22] Filed: Apr. 17, 1997

[51] Int. Cl.[6] ..... F01C 1/04

[52] U.S. Cl. ..... 418/55.3; 418/55.4; 418/55.5; 418/57

[58] Field of Search ..... 418/55.3, 55.4, 418/55.5, 57

[56] References Cited

U.S. PATENT DOCUMENTS

| | | | |
|---|---|---|---|
| 5,080,566 | 1/1992 | Sakata et al. | 418/55.3 |
| 5,445,507 | 8/1995 | Nakamura et al. | 418/55.1 |
| 5,540,572 | 7/1996 | Park et al. | 418/55.5 |
| 5,743,720 | 4/1998 | Sano et al. | 418/55.5 |

FOREIGN PATENT DOCUMENTS

| | | | |
|---|---|---|---|
| 3237283 | 10/1991 | Japan | 418/55.5 |
| 4362201 | 12/1992 | Japan | 418/55.5 |
| 6-26471 | 2/1994 | Japan | 418/57 |
| 6264877 | 9/1994 | Japan | 418/55.5 |

*Primary Examiner*—John J. Vrablik
*Attorney, Agent, or Firm*—Harness, Dickey & Pierce, P.L.C.

[57] ABSTRACT

A scroll compressor includes a hermetic shell which has a partition defining a discharge pressure chamber and a suction pressure chamber within the shell. The partition includes a surface which pilots the non-orbiting scroll to allow for limited axial movement of the non-orbiting scroll. Rotational motion of the non-orbiting scroll is prohibited by a stationary pin which extends from the partition to engage an extension of the slot which is utilized by the Oldham coupling.

14 Claims, 3 Drawing Sheets

PARTITION AND PILOT RING FOR SCROLL MACHINE

FIELD OF THE INVENTION

The present invention relates generally to scroll type machines. More particularly, the present invention relates to a partition for a scroll machine which also functions as a pilot ring for locating the non-orbiting scroll member.

BACKGROUND AND SUMMARY OF THE INVENTION

Scroll machines are generally provided with an outer shell which defines an internal hermetic chamber. A partition, often termed a muffler plate, is positioned within the internal hermetic chamber to define a suction pressure chamber and a discharge pressure chamber. A scroll assembly is located within the hermetic chamber of the outer shell and it includes an orbiting scroll member and a non-orbiting scroll member. Each scroll member has a spiral wrap and these spiral warps are mutually intermeshed to define at least one enclosed space of progressively changing volume between a suction pressure region and a discharge pressure region. The suction pressure region is in communication with the suction pressure chamber and the discharge pressure region is in communication with the discharge pressure chamber. A flow passage is normally formed through an end plate of one of the scroll members for allowing the fluid communication between the discharge pressure region and the discharge pressure chamber. Thus, the partition or muffler plate must allow fluid communication between the discharge pressure region and the discharge pressure chamber while effectively sealing the discharge pressure chamber from the suction pressure chamber.

Various designs for partitions or muffler plates have been developed which meet the requirements of sealing between the discharge pressure chamber and the suction pressure chamber while performing additional functions such as providing for the mounting and installation of an internal pressure relief valve.

While some scroll compressors have been developed having a fixed non-orbiting scroll and an orbiting scroll, other scroll compressors permit a small amount of axial movement of the non-orbiting scroll and then utilize fluid pressure biasing to bias the non-orbiting scroll into engagement with the orbiting scroll to enhance the sealing between the wraps of the scroll members. These axially movable non-orbiting scrolls thus require a movable seal assembly disposed between the non-orbiting scroll and the partition or muffler plate in order for the partition or muffler plate to meet its sealing requirements. In addition, the axial mounting systems for the non-orbiting scroll must permit axial movement of the non-orbiting scroll while simultaneously prohibiting rotational movement of the non-orbiting scroll. Applicants Assignee's U.S. Pat. No. 5,102,316 entitled "Non-Orbiting Scroll Mounting Arrangements for a Scroll Machine", the disclosure of which is hereby incorporated herein by reference, discloses various systems for mounting axially movable non-orbiting scrolls.

The present invention discloses a partition which separates the internal hermetic chamber of a scroll machine into a discharge pressure chamber and a suction pressure chamber. In addition, the partition pilots the non-orbiting scroll member for limited axial movement while properly locating it within the internal hermetic chamber. A pin assembly disposed between the partition and the non-orbiting scroll member in one embodiment prohibits rotational movement of the non-orbiting scroll relative to the partition. In another embodiment, the pin assembly is disposed between the main bearing housing and the non-orbiting scroll to prohibit rotational movement of the non-orbiting scroll relative to the main bearing housing. Both the piloting of the non-orbiting scroll by the partition and the pin assembly allow the axial movement of the non-orbiting scroll necessary to enhance sealing between the wraps of the two scroll members.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
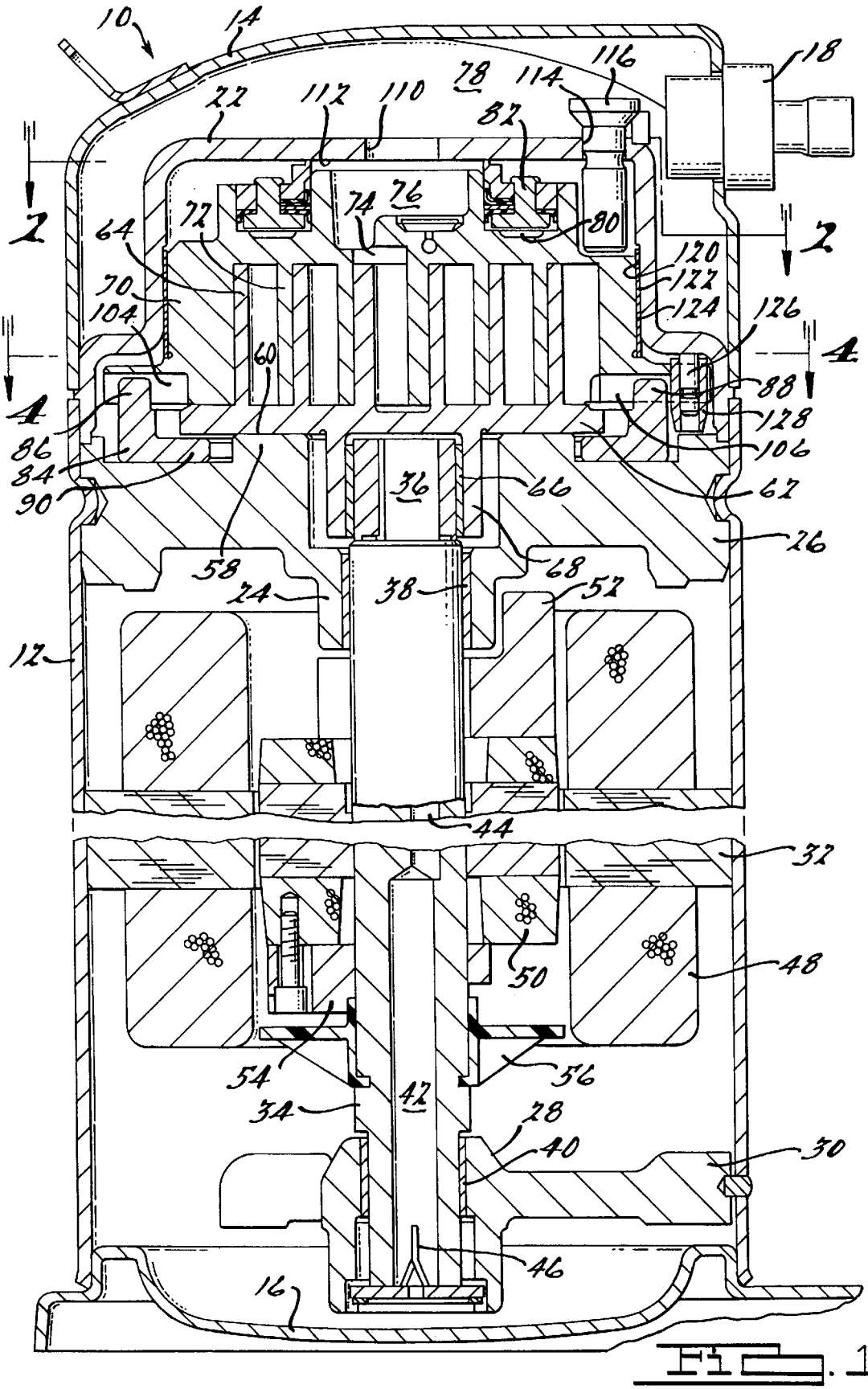
FIG. 1 is a vertical sectional view of a scroll type refrigerant compressor incorporating the partition and pilot ring in accordance with the present invention.
Figure 2:
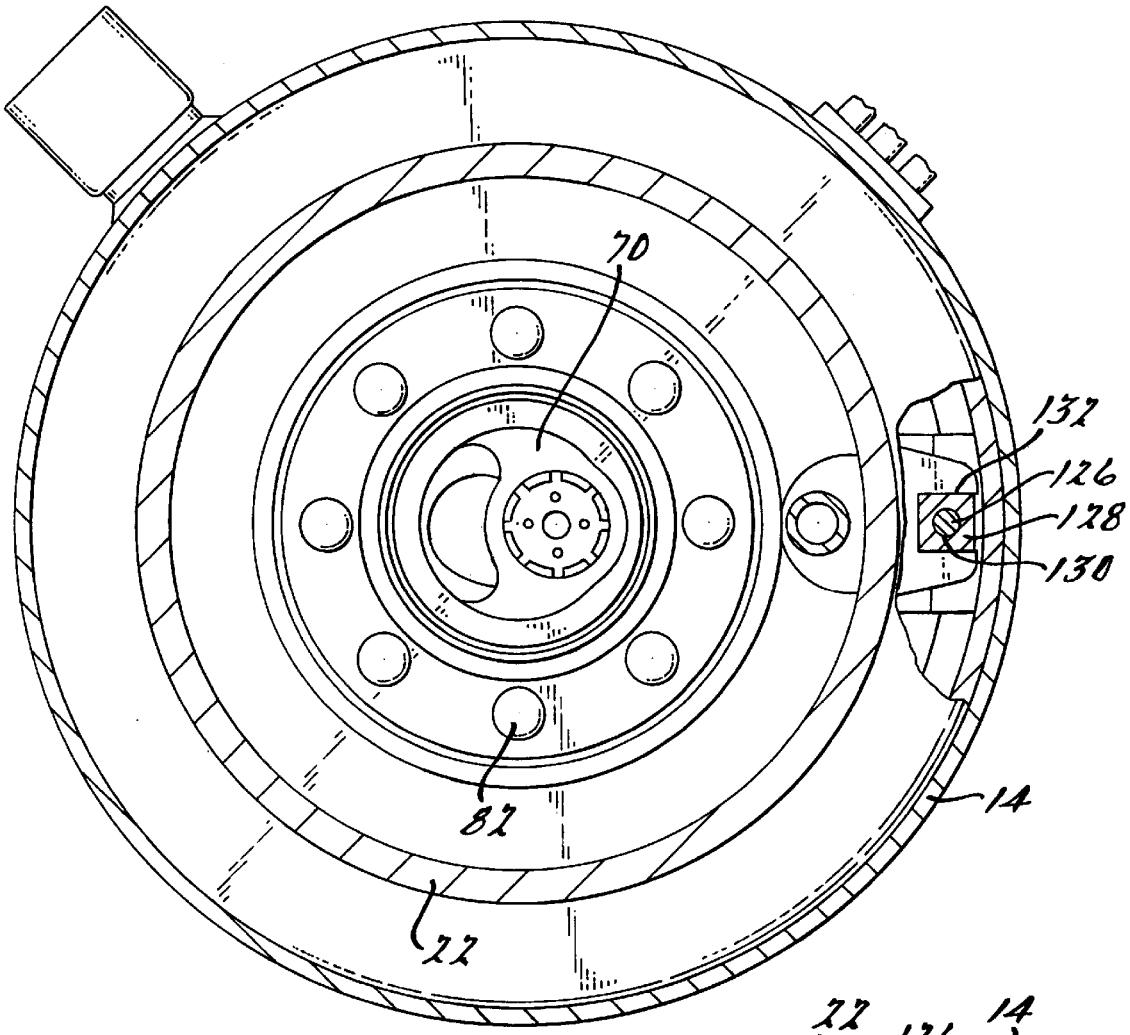
FIG. 2 is a cross-sectional view of the compressor shown in FIG. 1, the section being taken along line 2—2 thereof.

Referring now to the drawings in which like reference numerals designate like or corresponding parts throughout the several views, there is shown in FIG. 1, a scroll compressor incorporating the partition and pilot ring in accordance with the present invention with the scroll compressor being identified generally by the reference numeral 10. Compressor 10 comprises a generally hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 having a plurality of radially outwardly extending legs 26, each of which is suitably secured to shell 12 and a lower bearing housing 28 also having a plurality of radially outwardly extending legs 30 each of which is suitably secured to shell 12. A motor stator 32 which is generally square in cross section but with corners rounded off is press fitted into shell 12. The flats between the rounded corners on the stator provide passageways between stator 32 and shell 12 which facilitate the flow of lubricant from the top of shell 12 to the bottom.

A driveshaft or crankshaft 34 having an eccentric crank pin 36 at the upper end thereof is rotatably journalled in a bearing 38 in main bearing housing 24 and a second bearing 40 in lower bearing housing 28. Crankshaft 34 has at the lower end thereof a relatively large diameter concentric bore 42 which communicates with a radially outwardly inclined smaller diameter bore 44 extending upwardly therefrom to the top of crankshaft 34. Disposed within bore 42 is a stirrer 46. The lower portion of the interior of shell 12 is filled with lubricating fluid and bore 42 acts as a pump to pump lubricating fluid up crankshaft 34 and into passageway 44 which in turn pumps lubricating fluid to all of the various components within compressor 10 which require lubrication.

Crankshaft 34 is rotatably driven by an eccentric motor including stator 32, windings 48 passing therethrough and a rotor 50 press fitted on crankshaft 34 and having upper and lower counterweights 52 and 54 respectively. A counterweight shield 56 may be provided to reduce the work loss caused by counterweight 54 spinning in the oil in the sump.

A generally cylindrical upper portion 58 of main bearing housing 24 defines a flat thrust bearing surface 60 on which is supported an orbiting scroll 62 having the usual end plate and spiral vane or wrap 64 projecting from the upper surface thereof. Projecting downwardly from the lower surface of the end plate of orbiting scroll 62 is a cylindrical hub having a journal bearing 66 therein and in which is rotatably disposed a drive bushing 68 having an inner bore in which crank pin 36 of crankshaft 34 is drivingly disposed. Crank pin 36 has a flat on one surface which drivingly engages a flat surface formed in a portion of the bore of drive bushing 68 to provide a radially compliant driving arrangement, such as described in Assignee's U.S. Pat. No. 4,877,382, the disclosure of which is herein incorporated by reference.

A non-orbiting scroll member 70 is also provided having an end plate and a wrap 72 projecting therefrom which is positioned in meshing engagement with wrap 64 of orbiting scroll 62. Non-orbiting scroll member 70 has a centrally disposed discharge passage 74 which communicates with an upwardly open recess 76 which is in turn in fluid communication with a discharge muffler chamber 78 defined by cap 14 and partition 22. An annular recess 80 is also formed in non-orbiting scroll member 70 within which is disposed a seal assembly 82. Recesses 76 and 80 and seal assembly 82 cooperate to define axial pressure biasing chambers which receive pressurized fluid being compressed by wraps 64 and 72 so as to exert an axial biasing force on non-orbiting scroll member 70 to thereby urge the tips of respective wraps 64 and 72 into sealing engagement with the opposed end plate surfaces. Seal assembly 82 is preferably of the type described in greater detail in Assignee's U.S. Pat. No. 5,156,539, the disclosure of which is hereby incorporated by reference.

In order to prevent relative rotation between scroll members 62 and 70, an Oldham coupling 84 is provided being positioned in surrounding relationship to cylindrical portion 58 of main bearing housing 24 and immediately below the end plate of orbiting scroll member 62. Oldham coupling 84 includes a pair of keys 86 and 88 provided on an annular ring 90 in diametrically aligned relationship and projecting axially upward from annular ring 90. A second pair of keys 92 and 94, see FIG. 4, project axially upward from annular ring 90 and are positioned on a pair of outwardly projecting flange portions.

Figure 4:
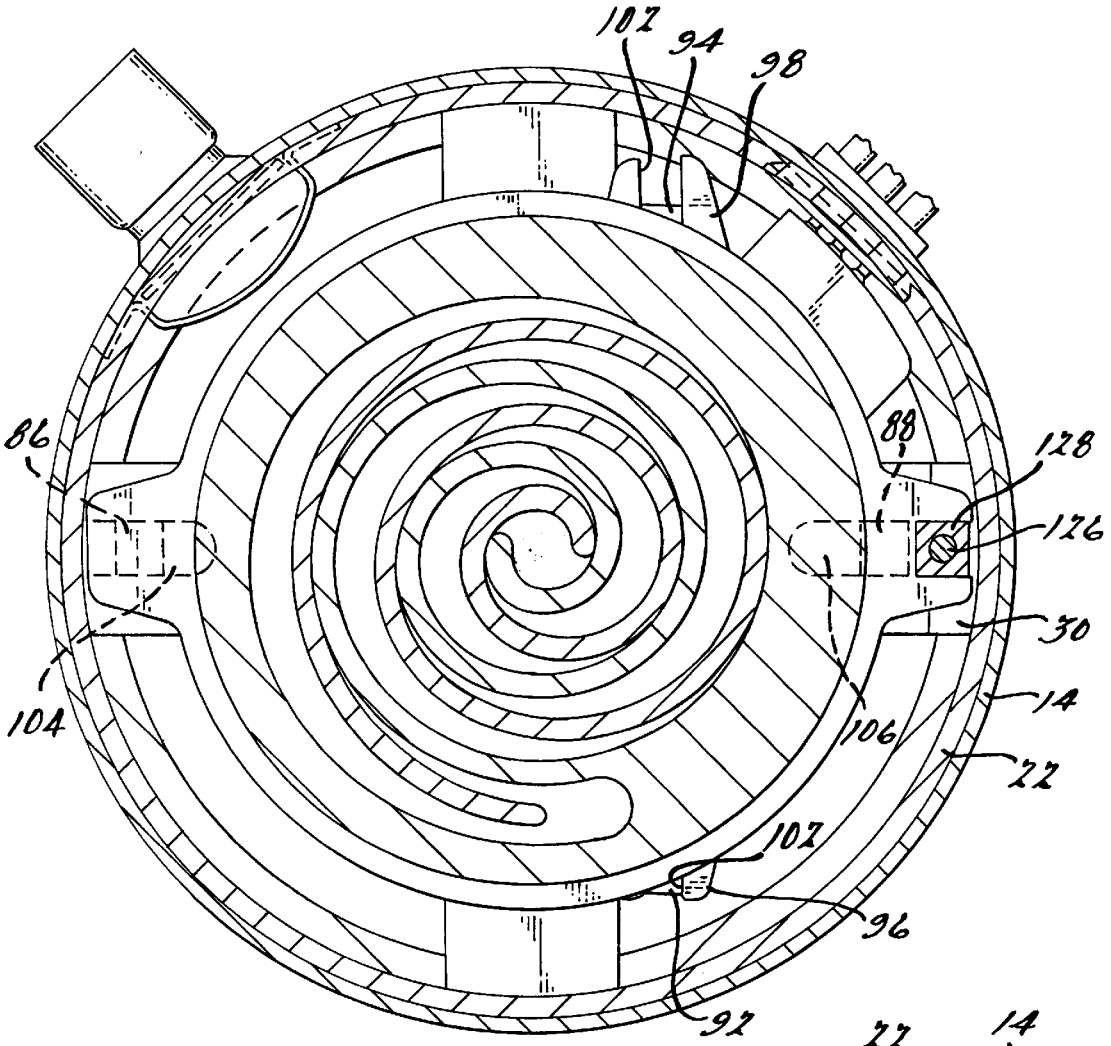
FIG. 4 is a cross-sectional view of the compressor shown in FIGS. 1–3, the section being taken along line 4—4 shown in FIG. 1.

As shown in FIG. 4, the end plate of orbiting scroll member 62 is provided with a pair of outwardly projecting flange portions 96 and 98 each of which is provided with an outwardly opening slot 102. Slots 102 are sized to slidingly received keys 92 and 94. Keys 92 and 94 have an axial length or height so as to avoid projecting above the upper surface of the end plate of orbiting scroll member 62.

Referring now to FIG. 1, non-orbiting scroll member 70 is similarly provided with a pair of radially extending aligned slots 104 and 106 which are designed to receive respective keys 86 and 88. Keys 86 and 88 are substantially longer than keys 92 and 94 and of sufficient length to project above the end plate of orbiting scroll member 62 and remain in engagement with slots 104 and 106 throughout the limited axial movement of non-orbiting scroll member 70 described above. The axial length or height of keys 86 and 88 are designed to provide a slight clearance between the end of the keys and the overlying surfaces of respective slots 104 and 106. This allows for the seating of non-orbiting scroll member 70 against orbiting scroll member 62 and avoids any possibility of interference with the tip sealing between the respective scroll members.

Partition 22 is a cup shaped member which defines a discharge opening 110 which allows the fluid communication between recess 76 and discharge muffler chamber 78. An annular sealing seat 112 is disposed around opening 110. Seat 112 cooperated with floating seal assembly 82 to separate the suction pressure chamber from the discharge pressure chamber of compressor 10 while permitting the axial movement of non-orbiting scroll member 70. Partition 22 also defines an opening 114 within which is projection welded an IPR valve 116.

Partition 22 defines an internal surface 120 which accepts and mates with a pilot ring 122. Pilot ring 122 mates with an external surface 124 located on non-orbiting scroll member 70 in order to pilot non-orbiting scroll member 70 within partition 22 while permitting the axial movement of non-orbiting scroll member 70. Pilot ring 122 is a thin metal band which has an oil film between it an non-orbiting scroll member 70 and between it and partition 22. The oil films cushion and damp the interaction between these components.

Figure 3:
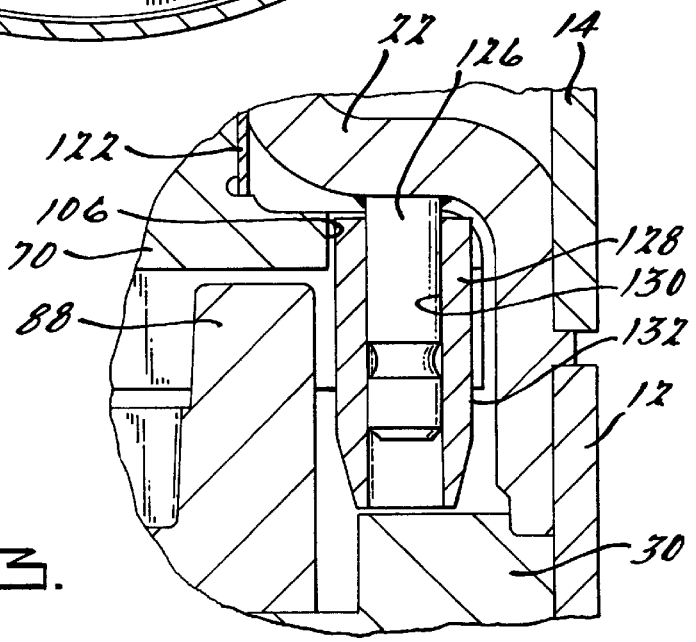
FIG. 3 is an enlarged fragmentary cross-sectional view showing the mounting pin arrangement for the non-orbiting scroll shown in FIG. 1.

Referring now to FIG. 3, operation of compressor 10 requires that non-orbiting scroll member 70 does not rotate. A cylindrical anti-rotation pin 126 is projection welded to partition 22 and extends downward from partition 22 to mate with a sleeve 128. Sleeve 128 has a round internal diameter 130 which slidingly accepts pin 126 and a generally rectangular outside configuration 132 which mates with an extension of slot 106. Rectangular outside configuration 132 provides a flat on flat contact with non-orbiting scroll member 70 and it is sized for a close sliding fit with slot 106 to minimize both impact and noise. The cylindrical shape of pin 126 and the extended length of sleeve 128 facilitate the assembly of the components of compressor 10. The extended length of sleeve 128 allows it to rest on one of the radially extending legs 26 of main bearing housing 24 during assembly and operation of compressor 10.

Partition 22 thus provides for the piloting of non-orbiting scroll member 70 during its limited axial movement and prevents rotation of non-orbiting scroll member 70 due to pin 126 and sleeve 128. The gasses being compressed by orbiting scroll member 62 and non-orbiting scroll member 70 produce forces on non-orbiting scroll member 70 which are transferred through partition 22 to shell 12. This is a different path than the prior art scroll compressors where the non-orbiting scroll member is bolted to a main bearing housing thus transferring the loads from the non-orbiting scroll member to the main bearing housing which is attached to the shell. The incorporation of partition 22 eliminates the manufacture and machining of attachment lugs on non-orbiting scroll member 70, eliminates the drilling and tapping of holes in legs 26 of bearing housing 24 and eliminates the various bolts and connectors associated with the prior art mounting systems which permit axial movement of non-orbiting scroll member 70. The present invention uses current structure to eliminate components. The elimination of these components and their associated machining significantly reduces the costs related to the manufacture of compressor 10.

Figure 5:
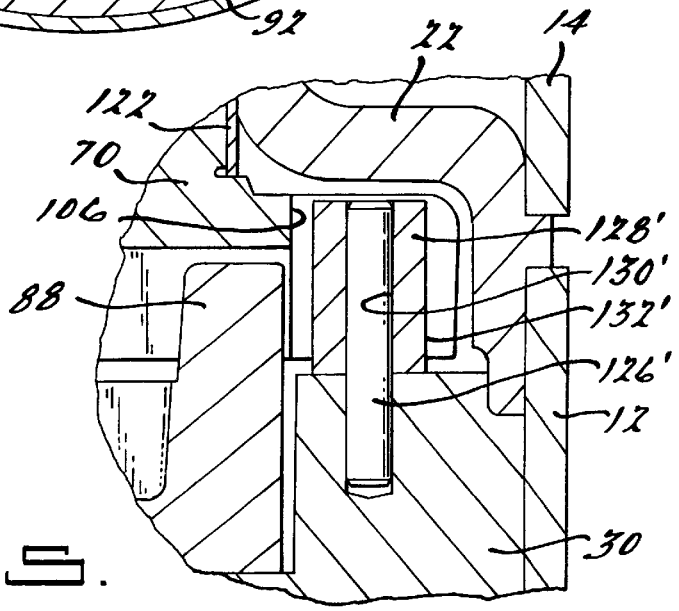
FIG. 5 is an enlarged fragmentary cross-sectional view showing the mounting pin arrangement for the non-orbiting scroll in accordance with another embodiment of the present invention.

FIG. 5 illustrates another embodiment for the mechanism which prohibits the rotational movement of non-orbiting scroll 70. A cylindrical anti-rotation pin 126' is pressed into a bore extending into one of legs 30 of main bearing housing 24. Pin 126' extends upward from leg 30 of main bearing housing 24 to mate with a sleeve 128'. Sleeve 128' has a round internal diameter 130' which slidingly accepts pin 126' and a generally rectangular outside configuration 132' which mates with the extension of slot 106 similar to sleeve 128. Rectangular outside configuration 132' provides a flat on flat contact with non-orbiting scroll member 70 and is sized for a close sliding fit with slot 106 to minimize both impact and noise.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a hermetic shell;

a first scroll member disposed in said shell and having a first spiral wrap, said first scroll member having an external cylindrical surface surrounding said first spiral wrap;

a second scroll member disposed in said shell and having a second spiral wrap, said wraps being mutually intermeshed;

means for causing said scroll members to orbit with respect to one another, whereby said wraps create at least one enclosed space of progressively changing volume between a suction pressure region and a discharge pressure region;

a cup-shaped partition defining a discharge chamber and a suction chamber within said shell, said partition having an internal cylindrical surface in engagement with said external cylindrical surface of said first scroll member for piloting said first scroll member for longitudinal movement with respect to said partition.

2. The scroll machine according to claim 1 further comprising a ring disposed between said partition and said first scroll member, said ring defining said internal cylindrical surface of said partition.

3. The scroll machine according to claim 1 wherein said partition engages said first scroll member to prohibit rotation of said first scroll member with respect to said partition.

4. The scroll machine according to claim 3 wherein said partition includes a pin which engages a slot in said first scroll member to prohibit said rotation.

5. The scroll machine according to claim 1 further comprising a seal disposed between said first scroll member and said partition, said seal isolating said discharge chamber from said suction chamber.

6. The scroll machine according to claim 1 wherein said means for causing said scroll members to orbit with respect to one another includes an Oldham coupling having a key which engages a slot in said first scroll member, said said partition engaging said first scroll member to prohibit rotation of said first scroll member with respect to said partition.

7. The scroll machine according to claim 6 wherein said partition includes a pin which engages said slot in said first scroll member to prohibit said rotation.

8. A scroll machine comprising:

a shell;

a partition having an internal cylindrical surface disposed within said shell, said partition defining a discharge chamber and a suction chamber within said shell;

a non-orbiting scroll member disposed within said suction chamber and having a first spiral wrap, said non-orbiting scroll member having an external cylindrical surface surrounding said first spiral wrap, said non-orbiting scroll member being piloted for longitudinal movement with respect to said partition by engagement between said external surface of said non-orbiting scroll member and said internal surface of said partition;

an orbiting scroll member disposed in said suction chamber and having a second spiral wrap, said spiral wraps being mutually intermeshed; and means for causing said orbiting scroll member to orbit with respect to said non-orbiting scroll member, whereby said wraps create at least one enclosed space of progressively changing volume between a suction pressure port defined by said scroll members and a discharge port defined by said non-orbiting scroll member.

9. The scroll machine according to claim 8 further comprising a ring disposed between said partition and said non-orbiting scroll member, said ring defining said internal cylindrical surface of said partition.

10. The scroll machine according to claim 8 wherein said partition engages said non-orbiting scroll member to prohibit rotation of said non-orbiting scroll member with respect to said partition.

11. The scroll machine according to claim 10 wherein said partition includes a pin which engages a slot in said non-orbiting scroll member to prohibit said rotation.

12. The scroll machine according to claim 8 further comprising a seal disposed between said non-orbiting scroll member and said partition, said seal isolating said discharge chamber from said suction chamber.

13. The scroll machine according to claim 8 wherein said means for causing said scroll members to orbit with respect to one another includes an Oldham coupling having a key which engages a slot in said non-orbiting scroll member, said partition engaging said non-orbiting scroll member to prohibit rotation of said non-orbiting scroll member with respect to said partition.

14. The scroll machine according to claim 13 wherein said partition includes a pin which engages said slot in said non-orbiting scroll member to prohibit said rotation.

* * * * *

UNITED STATES PATENT AND TRADEMARK OFFICE

CERTIFICATE OF CORRECTION

PATENT NO. : 5,897,306

DATED : April 27, 1999

INVENTOR(S) : Norman G. Beck

It is certified that error appears in the above-identified patent and that said Letters Patent is hereby corrected as shown below:

Column 3, line 63, "received" should be -- receive --.

Column 4, line 30, "an" should be -- and --.

Column 6, line 2, delete "said" (second occurrence).

Signed and Sealed this

Eighteenth Day of January, 2000

*Attest:*

*Attesting Officer*

Q. TODD DICKINSON

*Commissioner of Patents and Trademarks*